US009591895B2

(12) United States Patent
Shirai

(10) Patent No.: US 9,591,895 B2
(45) Date of Patent: Mar. 14, 2017

(54) BUCKLE

(71) Applicant: BUILMATEL CO., LTD., Chuou-ku, Tokyo (JP)

(72) Inventor: Syoji Shirai, Tokyo (JP)

(73) Assignee: BUILMATEL CO., LTD., Chuou-Ku, Tokyo (JP)

( * ) Notice: Subject to any disclaimer, the term of this patent is extended or adjusted under 35 U.S.C. 154(b) by 0 days.

(21) Appl. No.: 14/377,482

(22) PCT Filed: Aug. 7, 2013

(86) PCT No.: PCT/JP2013/071435
§ 371 (c)(1),
(2) Date: Aug. 7, 2014

(87) PCT Pub. No.: WO2014/073250
PCT Pub. Date: May 15, 2014

(65) Prior Publication Data

US 2015/0013115 A1 Jan. 15, 2015

(30) Foreign Application Priority Data

Nov. 8, 2012 (JP) ..... 2012-245987

(51) Int. Cl.
*A44B 11/10* (2006.01)
*A44B 11/22* (2006.01)
*A44B 11/16* (2006.01)

(52) U.S. Cl.
CPC ..... *A44B 11/10* (2013.01); *A44B 11/16* (2013.01); *A44B 11/223* (2013.01); *Y10T 24/4072* (2015.01)

(58) Field of Classification Search
CPC ..... A44B 11/20; A44B 11/24; A44B 11/223; A44B 11/25; A44B 11/258;
(Continued)

(56) References Cited

U.S. PATENT DOCUMENTS 809,465 A 1/1906 William et al.
1,627,776 A 5/1927 Haumerson
(Continued)

FOREIGN PATENT DOCUMENTS

CN 1302189 A 7/2001
CN 101522067 A 9/2009
(Continued)

OTHER PUBLICATIONS

International Search Report dated Oct. 15, 2013 issued in International Application No. PCT/JP2013/071435.
(Continued)

*Primary Examiner* — Jack W Lavinder
(74) *Attorney, Agent, or Firm* — Holtz, Holtz & Volek PC

(57) ABSTRACT

The buckle of the present invention is a buckle, of which engagement claw can be engaged with a serrate engagement groove of a band. The buckle includes: a buckle main body composed of a base plate and a roof frame, and two side plates connecting the base plate and the roof frame; and an operation piece being installed inside the roof frame, and having the engagement claw that can be engaged with the engagement groove of the band. The operation piece is movably supported by a connecting shaft connecting the two side plates in an intermediate point. The buckle main body is provided with a control piece for controlling a swing of the operation piece. The engagement claw is engaged with the engagement groove of the band, and the control piece functions as a spring for biasing the engagement claw toward the engagement groove side in such a locked state.

6 Claims, 4 Drawing Sheets

(58) Field of Classification Search
CPC ..... A44B 11/2584; A44B 11/2592; A44B 11/2588; A44B 11/263; A44B 11/06; A44B 11/26; A41F 1/008; A42B 3/145; Y10T 24/1498; Y10T 24/2106; Y10T 24/2113; Y10T 24/2104; Y10T 24/2142; Y10T 24/2143; Y10T 24/2166; Y10T 24/2183; Y10T 24/2192; Y10T 24/4501; Y10T 24/45503; Y10T 24/45246; Y10T 24/45623; A44C 11/12; A44C 1/003; A43B 5/04; F16L 3/233; F16L 3/2332; B65D 63/16; B65D 63/1027
USPC ..... 24/DIG. 46, DIG. 43, DIG. 47, DIG. 53
See application file for complete search history.

(56) References Cited

U.S. PATENT DOCUMENTS

| | | | | |
|---|---|---|---|---|
| 1,910,891 | A | 5/1933 | Freysinger | |
| 1,910,892 | A | 5/1933 | Freysinger et al. | |
| 4,577,375 | A | 3/1986 | Beaussant | |
| 5,774,953 | A * | 7/1998 | Mao | A44B 11/2592 24/170 |
| 6,457,210 | B1 * | 10/2002 | Shirai et al. | 24/16 PB |
| 8,146,211 | B2 | 4/2012 | Shirai et al. | |
| 2010/0175232 | A1 | 7/2010 | Shirai et al. | |
| 2010/0281661 | A1 | 11/2010 | Harada et al. | |
| 2012/0180197 | A1 | 7/2012 | Cosky | |
| 2012/0233743 | A1 | 9/2012 | Park | |
| 2015/0289600 | A1 | 10/2015 | Shirai | |

FOREIGN PATENT DOCUMENTS

| | | | |
|---|---|---|---|
| DE | 1231468 | B | 12/1966 |
| JP | 2000135103 | A | 5/2000 |
| JP | 2001204518 | A | 7/2001 |
| JP | 2004135724 | A | 5/2004 |
| JP | 3982955 | B2 | 9/2007 |
| JP | 4005109 | B1 | 11/2007 |
| JP | 4368023 | B2 | 11/2009 |
| JP | 2010220795 | A | 10/2010 |
| JP | 5049399 | B1 | 10/2012 |
| JP | 2012249999 | A | 12/2012 |
| WO | 0068742 | A2 | 11/2000 |
| WO | 2011034333 | A1 | 3/2011 |
| WO | 2011034333 | A2 | 3/2011 |
| WO | 2012165591 | A1 | 12/2012 |

OTHER PUBLICATIONS

Extended European Search Report dated Sep. 22, 2015, issued in counterpart European Application No. 13853794.9.
Extended European Search Report dated Sep. 7, 2015, issued in counterpart European Application No. 13853808.7.
Chinese Office Action (and English translation thereof) dated Nov. 26, 2015, issued in counterpart Chinese Application No. 201380058095.6.
International Search Report (ISR) dated Nov. 12, 2013 issued in International Application No. PCT/JP2013/072641.
U.S. Appl. No. 14/440,169; First Named Inventor: Syoji Shirai; Title: "Slide Adjuster"; Filed: May 1, 2015.
Non-Final Office Action dated Mar. 4, 2016, issued in related U.S. Appl. No. 14/440,169.
Chinese Office Action (and English translation thereof) dated Jun. 13, 2016, issued in counterpart Chinese Application No. 201380058095.6.

* cited by examiner

BUCKLE

TECHNICAL FIELD

The present invention relates to a buckle for locking a band or belt having an engagement groove, and relates in particular to a buckle that is used together with a watch band, an armband or wristband for smartphones or portable music players, or a band or belt of shoes or for shoes.

BACKGROUND ART

A buckle has been conventionally known, in which a band (or belt) is provided with an engagement groove; a hook of the buckle is elastically engaged with the groove; and such a locking state can be released at any time. In Japanese Patent No. 3982955 (Patent Document 1), the present inventors have proposed a synthetic-resin buckle that is easy to manufacture and light in weight, the buckle including: a buckle main body composed of a base plate and a roof frame opposed to each other, and two side plates connecting the base plate and the roof frame, in which an inside of the buckle main body is an insertion space for the band having an engagement groove; and an operation piece being horizontally installed inside the roof frame, and having, on an under surface of one end thereof, the engagement claw that can be engaged with the engagement groove of the band, in which an other end thereof is a pressing portion; the operation piece is connected to two sides of the opposed roof frame in an intermediate point between the engagement claw and the pressing portion, whereby allowing the operation piece to swing around the intermediate point as a fulcrum; and an outer surface of the band and the roof frame are provided with a pair of latching protrusions, with which the band can be pulled toward the buckle main body with a finger-tip of one hand.

The synthetic-resin buckle is significantly superior in function, and is optimal as a buckle for headbands of a helmet. However, if the connecting shaft is thinned to be applied to a product such as a watch band that relatively requires the buckle to be downsized, a strong force acts on the band in a direction of separating from the buckle when the band and the buckle are locked, and the synthetic-resin connecting shaft might be damaged. There was also a problem that the engagement strength of the band and the buckle deteriorates due to degradation of the elasticity over time, which is attributable to a creeping phenomenon (i.e. a property of synthetic resin to slowly deform when a strong pressure is applied to the synthetic resin for a long time).

In Japanese Patent No. 4005109 (Patent Document 2), the present inventors have also proposed a slide adjuster of a band and a buckle, which is suitably applied to products such as clothing ornaments in particular, the slide adjuster being light in weight and simple in configuration, in which the buckle portion has an inconspicuous external appearance; an engagement claw is engaged with a serrate engagement groove formed on an outer surface of a band, whereby allowing the band to approach but not to retreat relatively to the buckle in the locking state; the buckle includes: a buckle main body composed of a base plate and a roof frame opposed to each other, and two side plates connecting the base plate and the roof frame, in which an inside of the buckle main body is an insertion space for the band; and an operation plate being horizontally installed inside the roof frame, and having, on an under surface of one end thereof, the engagement claw that can be engaged with the engagement groove of the band, in which an other end thereof is a pressing portion for releasing the engagement; the operation plate is movably supported by a connecting shaft connecting the two side plates in an intermediate point between the locking claw and the pressing portion, whereby allowing the operation plate to swing around the intermediate point as a fulcrum; and an outer surface of the band and the pressing portion are provided with a pair of latching portions, with which the buckle and the band can be pulled toward each other with a finger-tip of one hand.

This slide adjuster can improve the strength of the connecting shaft by using a hard material such as metal or resin having no elasticity. However, in this case, it is necessary to provide separate parts such as a coiled spring. When such separate parts are provided, the structure of the buckle is complicated, and it has been difficult to manufacture a buckle that is light in weight, small in size, and easy to manufacture. With the synthetic-resin buckle and the slide adjuster, the buckle and the band can be pulled toward each other with a finger-tip of one hand. However, in order to withdraw the band from the buckle, it is necessary to withdraw the band with one hand, while pressing the pressing portion of the buckle with the other hand. Therefore, this was not suitable as a buckle to be used for a watch band, etc., which require the band to be withdrawn with one hand.

Patent Document 1: Japanese Patent No. 3982955
Patent Document 2: Japanese Patent No. 4005109

DISCLOSURE OF THE INVENTION

Problems to be Solved by the Invention

An object of the present invention is to provide a buckle that is light in weight, small in size, and easy to manufacture, in which the engagement strength of the band and the buckle does not deteriorate over time.

Means for Solving the Problems

The buckle of the present invention is a buckle, of which engagement claw can be engaged with a serrate engagement groove formed on an outer surface of a band, the buckle including: a buckle main body composed of a base plate and a roof frame opposed to each other, and two side plates connecting the base plate and the roof frame, in which an inside of the buckle main body is an insertion space for the band; and an operation piece being horizontally installed inside the roof frame, and having, on an under surface of one end thereof, the engagement claw that can be engaged with the engagement groove of the band, in which an other end thereof is a pressing portion for releasing the engagement, in which the operation piece is movably supported by a connecting shaft connecting the two side plates in an intermediate point, whereby allowing the operation piece to swing around the intermediate point as a fulcrum; the buckle main body is provided with a control piece for controlling a swing of the operation piece; and the engagement claw is engaged with the engagement groove of the band, and the control piece functions as a spring for biasing the engagement claw toward the engagement groove side in such a locked state, whereby allowing the band to advance but not to retreat, relatively to the buckle.

It is preferable that the control piece can be horizontally moved along an upper portion of the operation piece; and that the engagement can be released by moving the control piece. It is preferable that the engagement is released in a state where the control piece is moved to the other end side of the operation piece.

It is preferable that the control piece functions as a spring utilizing recoil when the operation piece swings to touch the control piece.

It is preferable that the buckle main body is provided with a latching portion, with which the buckle and the band can be pulled toward each other with a finger-tip of one hand.

Effects of the Invention

In the buckle of the present invention, the control piece functions as a spring for controlling the swing of the operation piece in the locking state of the band and the buckle; therefore, it is possible to provide a buckle that is light in weight, small in size, and easy to manufacture, without providing separate parts such as a coiled spring, in which the engagement strength of the band and the buckle does not deteriorate over time. Therefore, the present buckle is optimal for application to a product such as a watch band, which relatively requires a buckle to be downsized. Furthermore, the band can be withdrawn with one hand, by using the buckle in which the control piece can be horizontally moved.

EXPLANATION OF REFERENCE NUMERALS

Figure 1A:
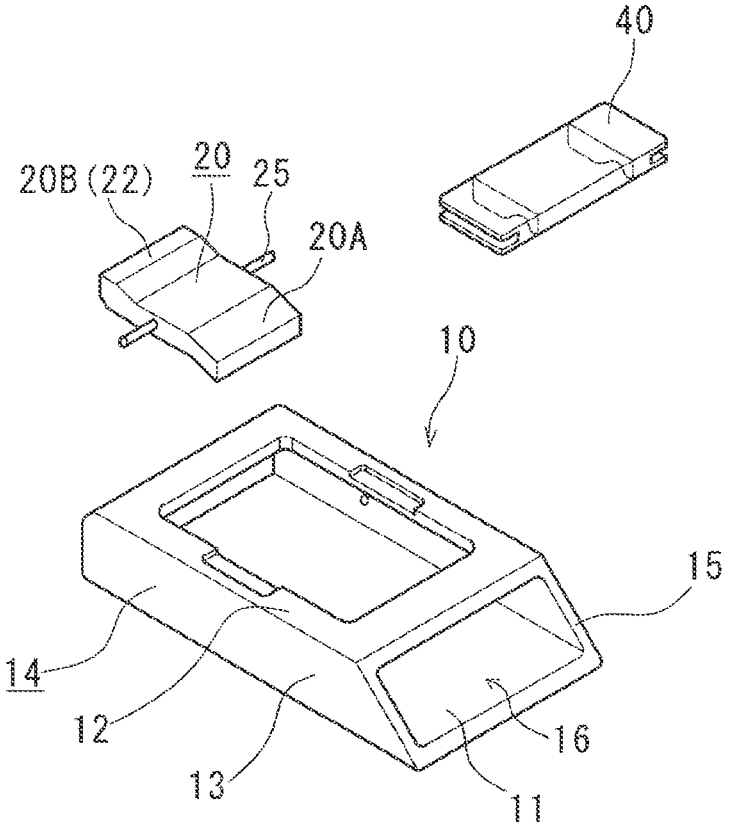
FIGS. 1A and 1B are perspective views of a buckle 10 of the present invention.

10 buckle
11 base plate
12 roof frame
13 side plate
14 buckle main body
16 insertion space
20 operation piece
20A one end of operation piece
20B other end of operation piece
21 engagement claw
22 pressing portion
25 connecting shaft
30 band
31 engagement groove
40 control piece

Preferred Mode for Carrying out the Invention

Figure 1B:
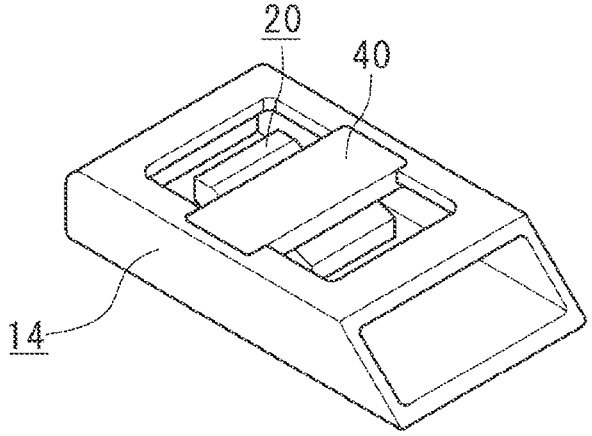

Embodiments of the buckle according to the present invention are hereinafter described with reference to the drawings. FIGS. 1A and 1B are perspective views of a buckle 10, in which FIG. 1A shows a state where an operation piece 20 and a control piece 40, which configure the buckle 10, are separated above from a buckle main body 14; and FIG. 1B shows a state where the operation piece 20 and the control piece 40 are installed in the buckle main body 14. In these drawings, the buckle 10 is mainly composed of: a base plate 11; a roof frame 12 opposed thereto; and the flat and cylindrical buckle main body 14 composed of side plates 13 and 13 that connect the base plate 11 with the roof frame 12. Insertion holes 15 and 15 of the buckle main body 14 are opened in a direction of sliding a band; and an inside thereof is an insertion space 16 for a band 30 having an engagement groove (to be described later).

In the present embodiment, the length of the base plate 11 in the longitudinal direction (the direction of sliding the band) is longer than the length of the roof frame 12 in the longitudinal direction, thereby facilitating the attachment of the buckle 10 to a connected body (i.e. a watch band, etc.), and allowing the band to be smoothly inserted. A similar effect can also be achieved by: configuring the roof frame 12 with a flat plate; and horizontality extending the roof frame 12, which is opposite to one end 20A of the operation piece 20, in a direction opposite to the operation piece 20.

The operation piece 20 having a dimension to fit inside the roof frame 12 is horizontally installed inside the roof frame 12. An under surface of the one end 20A of the operation piece 20 is provided with a projected engagement claw 21 that can be engaged with the engagement groove of the band 30; and an other end 20B of the operation piece 20 serves as a pressing portion 22 for releasing the engagement. The operation piece 20 is slightly lower in position than the roof frame 12, thereby making it possible to prevent the one end 20A or the other end 20B of the operation piece 20 from being accidentally pushed down.

A connecting shaft 25 is formed in an intermediate portion of the operation piece 20 in the longitudinal direction; and the connecting shaft 25 is movably supported by each upper inner wall of the side plates 13 and 13. As a result, the operation piece 20 can swing around the intermediate portion as a fulcrum. A cross section of the connecting shaft 25 is circular in the present embodiment, but can have elliptical or any other various cross-sectional shapes. The connecting shaft 25 is desired to be as thin as possible so as to swingably and pivotally support the operation piece 20 and secure smooth operability, and may have a shape and dimension that do not cause any damage due to repeated swings.

In the present invention, a material used for the connecting shaft is not limited in particular, and synthetic resin having elasticity may be used, or a hard material such as metal or resin having no elasticity may be used as well. In a case of using such a hard material, the strength of the connecting shaft per se is increased; therefore, the engagement strength of the band 30 and the buckle 10 is improved.

Inside the buckle main body 14, the control piece 40 is installed in a position above the operation piece 20. A shape of the control piece 40 is not limited in particular, as long as the shape achieves the function of controlling the swinging of the operation piece 20 (as described later).

Figure 2A:
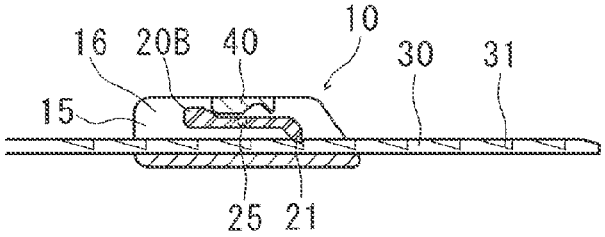
FIGS. 2A, 2B, 2C, and 2D are vertical cross-sectional side views of an essential part showing an engaged state of the buckle 10 and a band 30.
Figure 2B:
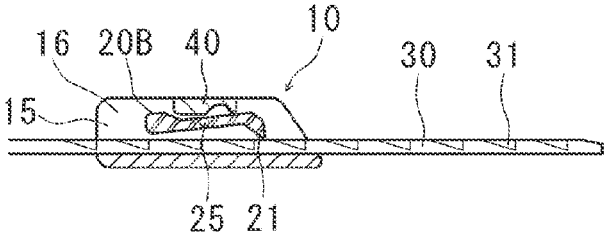

Next, functions of the buckle 10 are described with reference to FIGS. 2A and 2B. FIG. 2A is a vertical cross-sectional side view of an essential part showing an engaged state of the buckle 10 and the band 30. In FIG. 2A, the band 30 is inserted into the insertion space 16 of the buckle 10; and the engagement claw 21 of the buckle 10 is engaged with the engagement groove 31 formed on an outer surface of the band 30. A cross-sectional shape of the engagement groove 31 is serrate in the sliding direction; namely, the engagement groove 31 is composed of: a tapered surface that is gradually deepened in the traveling direction of the band 30; and a wall surface that substantially perpendicularly rises from the deepest position.

Figure 2C:
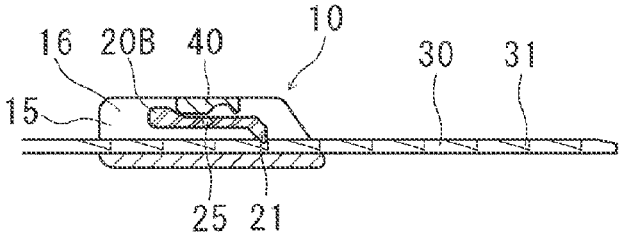

When the band 30 enters the insertion space 16 from the insertion hole 15 on the other end 20B side of the operation piece 20 (the left side in FIG. 2A), a top face of the band 30 comes in contact with the engagement claw 21 of the operation piece 20, and advances while pushing up the one end 20A of the operation piece 20 (see FIG. 2B); the operation piece 20 returns to the initial position by recoil by touching the control piece 40; and the approach/separation position of the band 30 relative to the buckle 10 is adjusted (see FIG. 2C). In other words, the control piece 40 functions as a spring for biasing the operation piece 20 toward the engagement groove 31 side of the band 30; therefore, in this state, the engagement claw 21 is locked while being engaged with a predetermined engagement groove 31, and the band 30 can advance but cannot retreat, relatively to the buckle 10.

The present invention does not utilize elasticity of the connecting shaft 25 per se; therefore, by using a material such as metal or resin having no elasticity for the connecting shaft 25, even if the connecting shaft 25 is thinned to downsize the buckle, the connecting shaft 25 is not likely to be damaged when a strong force acts in a direction of separating the band 30 from the buckle 10. The engagement strength is not likely to deteriorate, either, due to degradation of the elasticity of the connecting shaft 25 over time, which is attributable to a creeping phenomenon (i.e. a property of synthetic resin to slowly deform when a strong pressure is applied to the synthetic resin for a long time). Since the control piece 40 functions as a spring, it is not necessary to provide a coiled spring as a separate part, the parts count can be minimized, and the structure of the buckle 10 can be simplified.

Figure 2D:
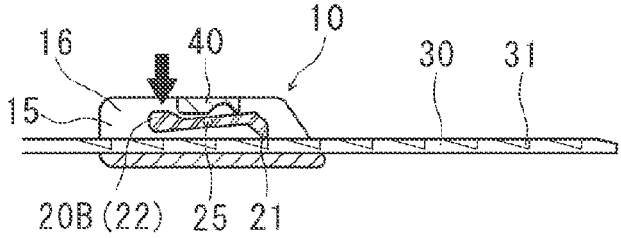

Next, when the band 30 is retreated or withdrawn from the buckle 10, the pressing portion 22 is pressed to rotate the operation piece 20 around the connecting shaft 25 as shown in FIG. 2D; as a result, the engagement claw 21 positioned on the opposite side is lifted; and the engagement claw 21 is disengaged from the engagement groove 31; therefore, the band 30 can be freely slid. By separating a finger from the pressing portion 22, the operation piece 20 in contact with the control piece 40 returns to the initial state by its recoil.

Figure 3A:
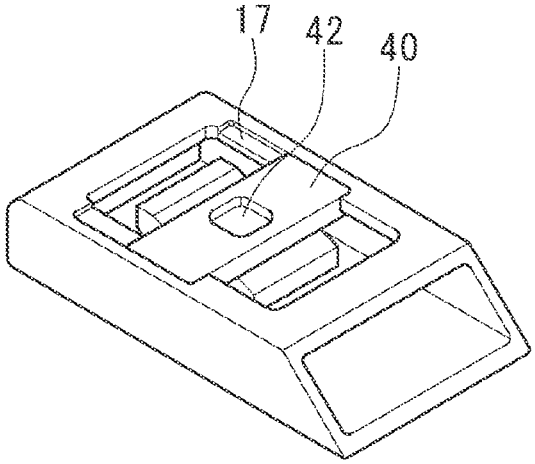
FIGS. 3A and 3B are perspective views showing another embodiment of the buckle 10.
Figure 4A:
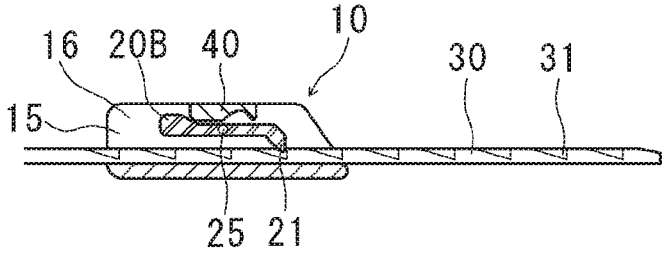
FIGS. 4A and 4B are vertical cross-sectional side views of an essential part showing an engaged state of the buckle 10 and the band 30 shown in FIG. 3A.

Next, another embodiment of the buckle 10 is described with reference to FIGS. 3A and 4A. FIG. 3A is a perspective view of the buckle 10; and FIG. 4A is a vertical cross-sectional side view of an essential part showing an engaged state of the buckle 10 and the band 30. However, the same reference numerals are assigned to the same members as described in the aforementioned embodiment, and descriptions thereof are omitted.

In the present embodiment, the control piece 40 is horizontally slid and moved along an upper portion of the operation piece 20, which is a point of difference from the embodiment described above. A surface of the control piece 40 is provided with a slide operation unit 42 as a concave portion. A shape of the slide operation unit 42 is not limited in particular, as long as a finger-tip of one hand can be hooked on the shape. The slide operation unit 42 does not necessarily have to be provided to the control piece 40, but such provision can facilitate the slide operation of the control piece 40.

Figure 3B:
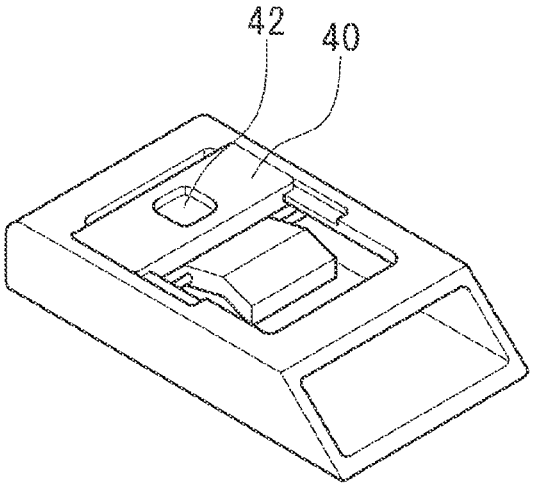

The two side plates 13 and 13 of the buckle 10 are provided with slide guides 17 and 17, respectively, for guiding the movement of the control piece 40. FIGS. 3A and 3B are perspective views showing a state where the control piece 40 is moved along the slide guides 17 and 17. In the present embodiment, the slide guides 17 and 17 are formed as grooves on the side plates 13 and 13 of the buckle 10; however, the position and shape of the slide guide 17 is not limited in particular, as long as the smooth movement of the control piece 40 can be guided.

Figure 4B:
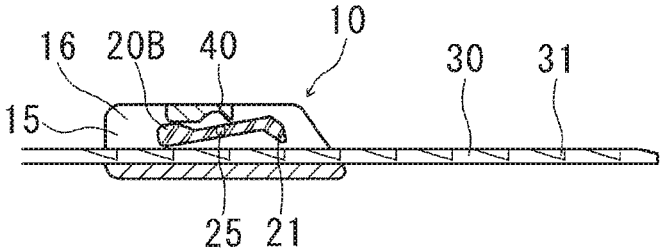
Figure 4C:
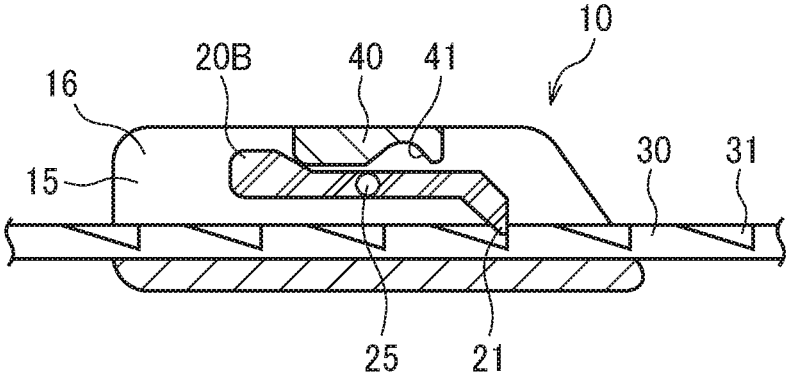
FIG. 4C is a partially enlarged view showing that a control piece 40 of a buckle main body 14 of the buckle 10 shown in FIGS. 2A-2D, 4A, and 4B has an obliquely inclined surface 41.

By sliding the control piece 40 along the slide guides 17 and 17 toward the other end 20B side of the operation piece 20 as shown in FIG. 3B, the operation piece 20 is rotated around the connecting shaft 25 as shown in FIG. 4B; as a result, the engagement claw 21 positioned on the opposite side is lifted; and the engagement claw 21 is disengaged from the engagement groove 31; therefore, the band 30 can be freely slid. By returning the control piece 40 to the original position along the slide guides 17 and 17, the operation piece 20 returns to the original horizontal state (see FIG. 4A.) And as shown in detail in FIG. 4C, which is a partially enlarged view of the configurations shown in FIGS. 2A-2D, 4A, and 4B, the control piece 40 (which is installed in the buckle main body 14) has an obliquely inclined surface 41.

According to the present embodiment, the band 10 can be freely withdrawn from the buckle 20 with one hand, by sliding the control piece 40 toward the other end 20B side of the operation piece 20. Therefore, the buckle is optimal as a buckle used for a watch band, etc. that require a one-handed operation.

Although not illustrated, in the buckle 10 of the present invention, the buckle main body 14 can be provided with a latching portion, with which the band 30 and the buckle 10 can be pulled toward each other with one hand. The latching portion does not necessarily have to be provided, but such provision facilitates the operation of pulling the band 30 and the buckle 10 toward each other with one hand. Therefore, by providing the latching portion to the aforementioned buckle 10, in which the control piece 40 can be horizontally moved, all the operations including the pulling of the band 30 and the buckle 10 toward each other, as well as the withdrawing of the band 30, can be easily performed with one hand.

In the present invention, the roof frame 12 is not necessarily limited to the one including four sides. One side opposite to the one end 20A of the operation piece 20 can be omitted, in a case of reducing the weight and/or size of the buckle.

The buckle 10 of the present invention can incorporate elements disclosed in Patent Documents 1 and 2 described above. For example, in order to make it easy to restore the operation piece 20 to the horizontal state, a joint member may be provided, which connects the one end 20A of the operation piece 20 with the opposing roof frame 12, etc. Furthermore, the insertion space 16 can be provided with a band suppressor (not illustrated) for preventing the band 30 from uplifting.

The invention claimed is:

1. A buckle, of which an engagement claw can be engaged with a serrate engagement groove formed on an outer surface of a band, the buckle comprising:

a buckle main body composed of a base plate and a roof frame opposed to each other, and two side plates connecting the base plate and the roof frame, wherein an inside of the buckle main body is an insertion space for the band; and an operation piece horizontally installed inside the roof frame, and having, on an under surface of one end thereof, the engagement claw that can be engaged with the engagement groove of the band, wherein an other end thereof is a pressing portion for releasing the engagement, wherein the operation piece is movably supported by a connecting shaft connecting the two side plates at an intermediate point, thereby allowing the operation piece to swing around the intermediate point as a fulcrum, wherein the buckle main body is provided with a control piece having a surface that is obliquely inclined relative to a direction perpendicular to a plane in which the band extends, and the control piece faces toward an upper surface of the operation piece so as to function as a spring and controls a swing of the operation piece, wherein the connecting shaft and the buckle main body are separate, individual components, and wherein in a locked state in which the engagement claw is engaged with the engagement groove of the band, when the band further enters the insertion space of the buckle main body, a top face of the band comes in contact with the engagement claw of the operation piece, and the band advances while pushing up the one end of the operation piece and while the operation piece contacts the control piece, and then the operation piece returns to an initial position by recoil force of the control piece, thereby allowing the band to advance but not to retreat, relatively to the buckle main body.

2. The buckle according to claim 1, wherein the control piece can be horizontally moved along an upper portion of the operation piece, and wherein the engagement can be released by moving the control piece.

3. The buckle according to claim 2, wherein the engagement is released in a state where the control piece is moved to the other end side of the operation piece.

4. The buckle according to claim 1, wherein the buckle main body is provided with a latching portion, with which the buckle and the band can be pulled toward each other with a finger-tip of one hand.

5. The buckle according to claim 1, wherein a bottom surface of the control piece that faces toward the upper surface of the operation control piece has a notch formed therein, the obliquely inclined surface of the control piece defined by an outlined of the notch when viewed in section.

6. The buckle according to claim 5, wherein the recoil force of the control piece is generated by the operation piece abutting against the control piece having the notch formed therein, when the band further enters the insertion space.

* * * * *